US008597134B2

(12) United States Patent
Naruo et al.

(10) Patent No.: US 8,597,134 B2
(45) Date of Patent: Dec. 3, 2013

(54) GOLF CLUB

(75) Inventors: Takeshi Naruo, Osaka (JP); Tetsuya Kanayama, Osaka (JP); Kazuya Ishida, Osaka (JP); Takashi Kimura, Osaka (JP); Yoshinobu Watanabe, Osaka (JP)

(73) Assignee: Mizuno Corporation, Osaka (JP)

( * ) Notice: Subject to any disclaimer, the term of this patent is extended or adjusted under 35 U.S.C. 154(b) by 230 days.

(21) Appl. No.: 13/103,321

(22) Filed: May 9, 2011

(65) Prior Publication Data

US 2012/0129622 A1 May 24, 2012

(30) Foreign Application Priority Data

May 13, 2010 (JP) ..... 2010-111252

(51) Int. Cl.
*A63B 53/00* (2006.01)

(52) U.S. Cl.
USPC ..... 473/292; 473/297; 473/282

(58) Field of Classification Search
USPC ..... 473/292, 297, 282
See application file for complete search history.

(56) References Cited

U.S. PATENT DOCUMENTS

| | | | | | |
|---|---|---|---|---|---|
| 5,152,527 | A * | 10/1992 | Mather et al. | ..... | 473/291 |
| 5,417,108 | A * | 5/1995 | Chastonay | ..... | 73/65.03 |
| 5,716,289 | A * | 2/1998 | Okoneski | ..... | 473/297 |
| 5,792,946 | A * | 8/1998 | Chastonay | ..... | 73/65.03 |
| 5,879,241 | A * | 3/1999 | Cook et al. | ..... | 473/289 |
| 6,106,411 | A * | 8/2000 | Edwards | ..... | 473/292 |
| 6,302,806 | B1 * | 10/2001 | Hsu | ..... | 473/320 |
| 6,478,689 | B1 * | 11/2002 | Hisamatsu | ..... | 473/287 |
| 7,326,125 | B2 * | 2/2008 | Moriyama | ..... | 473/292 |
| 7,568,982 | B2 * | 8/2009 | Cackett et al. | ..... | 473/300 |
| 8,066,583 | B2 * | 11/2011 | Rice et al. | ..... | 473/282 |
| 8,216,085 | B2 * | 7/2012 | Fujimoto | ..... | 473/292 |
| 8,241,139 | B2 * | 8/2012 | Brekke et al. | ..... | 473/292 |
| 2006/0142093 | A1 | 6/2006 | Moriyama | | |
| 2007/0105642 | A1 | 5/2007 | Ban | | |

FOREIGN PATENT DOCUMENTS

| | | | |
|---|---|---|---|
| JP | 9-253242 | * | 9/1997 |
| JP | 2000-185119 | | 7/2000 |
| JP | 2000202069 | | 7/2000 |
| JP | 2000225215 | | 8/2000 |
| JP | 2001276289 | | 10/2001 |

(Continued)

OTHER PUBLICATIONS

Notice of Grounds of Rejection issued by Japanese Patent Office Jun. 19, 2012 for co-pending Japanese Application No. 2010-111252.

(Continued)

*Primary Examiner* — Stephen L. Blau
(74) *Attorney, Agent, or Firm* — Troutman Sanders LLP; James E. Schutz; Robert R. Elliott, Jr.

(57) ABSTRACT

A golf club having a value of L not less than 45.5 inches, with L representing a club length measured with a 60-degree method, includes a shaft, a grip attached to one end of the shaft, and a head attached to the other end of the shaft. A value of r/L is equal to or not smaller than 0.658 and equal to or not greater than 0.732, where r represents a distance from an upper end of the grip to the center of gravity of the golf club. Thus, a long-length golf club achieving an increased head speed can be obtained.

3 Claims, 8 Drawing Sheets

(56) References Cited

FOREIGN PATENT DOCUMENTS

| | | | |
|---|---|---|---|
| JP | 2002219198 | | 8/2002 |
| JP | 2002-263222 | * | 9/2002 |
| JP | 2002263222 | | 9/2002 |
| JP | 2004181217 | | 7/2004 |
| JP | 2004313781 | | 11/2004 |
| JP | 2005198816 | | 7/2005 |
| JP | 2008-158684 | * | 6/2006 |
| JP | 2006204893 | | 8/2006 |
| JP | 2007130087 | | 5/2007 |

OTHER PUBLICATIONS

Decision to Grant Patent issued by the Japanese Patent Office for related Japanese Patent Application No. 2010-111252 dated Jun. 4, 2013.

* cited by examiner

GOLF CLUB

This nonprovisional application is based on Japanese Patent Application No. 2010-111252 filed with the Japan Patent Office on May 13, 2010, the entire contents of which are hereby incorporated by reference.

BACKGROUND OF THE INVENTION

1. Field of the Invention

The present invention relates to a golf club, and particularly to what is called a long-length golf club.

2. Description of the Background Art

A golf club is demanded to achieve an improved carry. In order to improve a carry, it is effective to increase a head speed of the golf club. In order to increase a head speed of the golf club, it is effective to increase a club length of the golf club. Therefore, a club length of the golf club tends to be longer. A club length of the golf club of 43 inches has previously been the mainstream, whereas a length of 45 inches is currently the mainstream. Currently, what is called a long-length golf club having a club length not shorter than 45.5 inches has also been used.

Simply increasing a club length of a golf club leads to greater moment of inertia, which results in difficulty in swinging the golf club. Then, it has been proposed to lessen moment of inertia of the golf club. For example, Japanese Patent Laying-Open No. 2000-185119 proposes a golf club that can lightly be swung. In the golf club in this publication, a weight which is a concentrated mass is additionally provided in the inside of the grip. This weight is provided within a range of 4 cm around a center of rotation of the grip. In addition, this weight is described as optimally weighing 5 g to 18 g. Moment of inertia of this golf club is thus lessened.

It has been found that, in a case where a club length of the golf club is increased in order to increase a head speed of the golf club, many golfers have not successfully achieved an increased head speed when the club length is increased to 45.5 inches or longer. One of factors may be that a club length of the golf club not shorter than 45.5 inches leads to difficulty in swinging the golf club due to increase in weight of the golf club or the like and a swing velocity (angular velocity) of the golf club lowers. It has thus been found that simply increasing a club length of a golf club does not lead to an increased head speed.

It is noted that attention is not paid to increase in head speed in the golf club in the publication above. In addition, the publication above does not note a long-length golf club either.

SUMMARY OF THE INVENTION

The present invention was made in view of the above-described problems, and an object of the present invention is to provide a long-length golf club achieving an increased head speed.

A golf club according to the present invention is a golf club having a value of L not less than 45.5 inches, where L represents a club length measured with a 60-degree method, and the golf club includes a shaft, a grip attached to one end of the shaft, and a head attached to the other end of the shaft. A value of r/L is equal to or not smaller than 0.658 and equal to or not greater than 0.732, where r represents a distance from an upper end of the grip to the center of gravity of the golf club.

It has commonly been said that the longer a golf club is, the greater a head speed is. As a result of review by the present inventors, however, it has been found that a head speed does not necessarily increase. The present inventors have earnestly studied a technique to increase a head speed even when a golf club has a long length, and found that a head speed can be increased by lowering a ratio of the center of gravity of the golf club.

Developments of this finding will be described below. As a distance between a position of the center of gravity of a golf club and a center of rotation COR is defined as a radius of rotation $r_1$, motion of the golf club can be rotational motion determined by center of rotation COR and radius of rotation $r_1$ that vary momently. This radius of rotation $r_1$ will be described. Kineticism of an object at an arbitrary moment is nothing other than rotational motion around one point and that center is defined as center of rotation COR. It is also referred to as an instantaneous center. The instantaneous center is also defined as a point where an instantaneous velocity attains to 0. A distance between this center of rotation COR and the center of gravity of the golf club is defined as radius of rotation $r_1$. Therefore, this radius of rotation $r_1$ also momently varies.

With a distance between a head of the golf club and center of rotation COR being defined as a length of rotation $L_1$ and a velocity of a position of the center of gravity of the golf club being denoted as Vcg, a head speed Vh can be expressed as $Vh=L_1/r_1 \times Vcg$.

When a swing is decomposed for consideration, the longer a golf club is, the greater length of rotation $L_1$ and also radius of rotation $r_1$ become. Therefore, simply increasing a club length of a golf club does not lead to greater $L_1/r_1$. In addition, as a result of review by the present inventors, it has been found that a velocity of a position of the center of gravity Vcg hardly varies. Therefore, if $L_1/r_1$ can be increased, a head speed can be increased.

In order to increase $L_1/r_1$, $L_1$ should only be greater and $r_1$ should only be smaller. Namely, it has been found that a golf club having a long length and having a position of the center of gravity located at hand is effective. Namely, $L_1/r_1$ can be increased by increasing a club length and making smaller a distance from the upper end of the grip to the center of gravity of the golf club.

A value calculated by dividing a distance r from the upper end of the grip to the center of gravity of the golf club by a club length L indicates a ratio of the center of gravity r/L. Increase in $L_1/r_1$ corresponds to lowering in ratio of the center of gravity r/L representing one of the specifications of a golf club.

The present inventors noted the ratio of the center of gravity based on this finding, and conceived that a head speed can be increased by optimizing the ratio of the center of gravity even when a golf club has a long length. The present inventors found that a long-length golf club can be designed such that a head speed is increased, by optimizing the ratio of the center of gravity.

A 60-degree method refers to a method of measuring a club length defined in Rules of Golf issued by The Japan Gold Association. According to this measurement method, a club length is defined as a distance from an intersection of two faces when a club is placed on a horizontal plane and a sole abuts a face at an angle of 60 degrees to the upper end of the grip. In addition, a golf club having a club length not shorter than 45.5 inches is defined as a long-length golf club.

As a result of earnest studies conducted by the inventors, it was conceived that a golf club having club length L not shorter than 45.5 inches achieves an increased head speed when a value of ratio of the center of gravity r/L is equal to or not smaller than 0.658 and equal to or not greater than 0.732, where r represents a distance from the upper end of the grip to the center of gravity of the golf club. Namely, a long-length golf club not shorter than 45.5 inches can achieve an increased head speed.

Preferably, the golf club above has a value of r equal to or not smaller than 0.785 m and equal to or not greater than 0.865 m. Thus, a long-length golf club not shorter than 45.5 inches can achieve an increased head speed.

Preferably, the golf club above has the value of L not less than 46.5 inches. Thus, even when a club length is increased to 46.5 inches or longer, a head speed can be increased.

Preferably, the golf club above has the value of r/L equal to or not smaller than 0.693 and equal to or not greater than 0.720. As a result of earnest studies conducted by the inventors, it was conceived that ease in swing can be improved when a long-length golf club has a value of r/L equal to or not smaller than 0.693 and equal to or not greater than 0.720. Thus, a head speed can be increased and ease in swing can also be improved.

Preferably, the golf club above has a value of r equal to or not smaller than 0.818 m and equal to or not greater than 0.850 m. Thus, ease in swing can be improved. Therefore, a head speed can be increased and ease in swing can also be improved.

Preferably, the golf club above has a value of Lp equal to or not smaller than 1.082 m and equal to or not greater than 1.109 m, where Lp represents an equivalent pendulum length of the golf club with the upper end of the grip serving as an axis of rotation. The equivalent pendulum length refers to a value calculated by dividing moment of inertia by first moment. Moment of inertia refers to a quantity indicated by a golf club gyrating with the upper end of the grip serving as the fulcrum. First moment refers to a value calculated by multiplying a mass of a golf club by a distance from the upper end of the grip to the center of gravity of the golf club.

As a result of earnest studies conducted by the inventors, it was conceived that a golfer makes favorable evaluation in preference evaluation when a long-length golf club has a value of Lp equal to or not smaller than 1.082 m and equal to or not greater than 1.109 m. Thus, a head speed can be increased and favorable evaluation can be obtained from a golfer. In addition, ease in swing can also be improved.

Preferably, the golf club above has a weight for adjusting r arranged in an area distant from the upper end of the grip by not shorter than 0.1 m and not longer than 0.5 m. Thus, a head speed can be increased by optimizing the ratio of the center of gravity. In addition, favorable evaluation can be obtained from a golfer by arranging a weight at a lower end of the grip. Moreover, since a range of a position of the weight can be selected, a degree of freedom in design can be improved.

Preferably, the golf club above has the weight having a mass equal to or not smaller than 12 g and equal to or not greater than 40 g. Thus, a head speed can be increased by optimizing the ratio of the center of gravity. In addition, since a range of a weight of the weight can be selected, a degree of freedom in design can be improved.

Preferably, the golf club above has the weight formed of tungsten-containing pre-preg. The tungsten-containing pre-preg is such a material that tungsten powders are contained in a resin. By employing the tungsten-containing pre-preg used for manufacturing a golf club for a weight, a special manufacturing apparatus is not necessary and hence productivity can be improved.

As described above, according to the golf club of the present invention, a long-length golf club can achieve an increased head speed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

One embodiment of the present invention will be described hereinafter with reference to the drawings.

Figure 1:
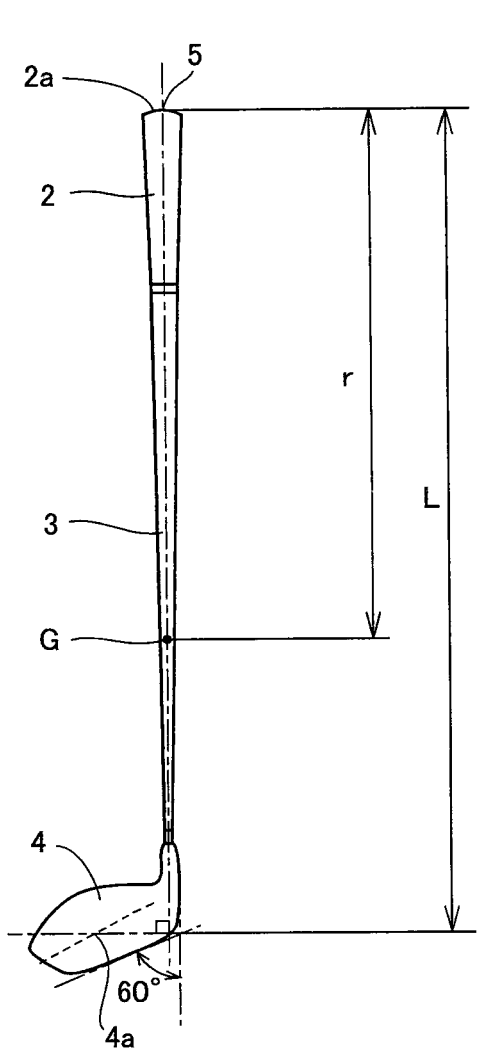
FIG. 1 is a schematic front view of a golf club in one embodiment of the present invention.

Referring to FIG. 1, a golf club 1 in one embodiment of the present invention is formed such that a value of L is not less than 45.5 inches (in), where L represents a club length measured with the 60-degree method. It is noted that 45.5 inches (in) are equivalent to 1.156 meter (m). Golf club 1 mainly includes a grip 2, a shaft 3, and a head 4. Grip 2 is attached to one end of shaft 3 and head 4 is attached to the other end of shaft 3. Head 4 has an impact face 4*a*.

A value of a ratio of the center of gravity r/L calculated by dividing distance r from an upper end 2*a* of grip 2 to center of gravity G of golf club 1 by club length L is set to be equal to or not smaller than 0.658 and equal to or not greater than 0.732. A value of distance r from upper end 2*a* of grip 2 to center of gravity G of golf club 1 is set to be equal to or not smaller than 0.785 m and equal to or not greater than 0.865 m.

Alternatively, a value of club length L of golf club 1 may be set to be not less than 46.5 inches. In addition, a value of ratio of the center of gravity r/L may be set to be equal to or not smaller than 0.693 and equal to or not greater than 0.720. A value of distance r from upper end 2*a* of grip 2 to center of gravity G of golf club 1 may be set to be equal to or not smaller than 0.818 m and equal to or not greater than 0.850 m.

In order to improve ease in swing, it is effective to decrease an equivalent pendulum length Lp of golf club 1. In one embodiment of the present invention, according to actual swing analysis, a position of an axis of rotation 5 serving as the center of rotation of golf club 1 was set at upper end 2*a* of grip 2. Upper end 2*a* of grip 2 substantially corresponds to a rear end of shaft 3.

Equivalent pendulum length Lp (m) with upper end 2*a* of grip 2 serving as axis of rotation 5 refers to a value calculated by dividing moment of inertia I ($kg \cdot m^2$) around upper end 2*a* of grip 2 by a club mass m (kg) and distance r (m) from upper end 2*a* of grip 2 to center of gravity G of golf club 1 and it is expressed in the following equation (1).

$$Lp = I/(mr) \quad (1)$$

For golf club 1, a value of equivalent pendulum length Lp of golf club 1 with upper end 2*a* of grip 2 serving as axis of rotation 5 may be set to be equal to or not smaller than 1.082 m and equal to or not greater than 1.109 m.

In golf club 1, a weight for adjusting distance r from upper end 2*a* of grip 2 to center of gravity G of golf club 1 is arranged around upper end 2*a* of grip 2. As golf club 1 has a longer length, a mass of golf club 1 increases. By making smaller club mass m and making smaller distance r from upper end 2*a* of grip 2 to center of gravity G of golf club 1, moment of inertia I can be lessened.

In actual design, however, it is difficult to decrease a mass of head 4 in terms of strength. Therefore, it is difficult to decrease club mass m. Thus, in order to make smaller distance r from upper end 2*a* of grip 2 to center of gravity G of golf club 1, the weight is arranged around upper end 2*a* of grip 2 as described above.

For example, the weight for adjusting distance r from upper end 2*a* of grip 2 to center of gravity G of golf club 1 may be arranged in an area distant from upper end 2*a* of grip 2 by not shorter than 0.1 m and not longer than 0.5 m. In this case as well, distance r from upper end 2*a* of grip 2 to center of gravity G of golf club 1 can be made smaller.

The mass of the weight may be equal to or not smaller than 12 g and equal to or not greater than 40 g. More specifically, the mass of the weight may be set to 12 g, 20 g, 22 g, 32 g, or 40 g. The weight may be made of tungsten-containing pre-preg. More specifically, the tungsten-containing pre-preg may be layered on shaft 3.

A function and effect of the golf club in one embodiment of the present invention will be described.

As a result of earnest studies conducted by the inventors, it was conceived that, according to the golf club in one embodiment of the present invention, even a long-length golf club can achieve an increased head speed, for the reasons as follows.

Golf club 1 in one embodiment of the present invention is golf club 1 having a value of L not less than 45.5 inches, where L represents a club length measured with the 60-degree method, and it includes shaft 3, grip 2 attached to one end of shaft 3, and head 4 attached to the other end of shaft 3. A value of r/L is equal to or not smaller than 0.658 and equal to or not greater than 0.732, where r represents a distance from upper end 2*a* of grip 2 to center of gravity G of golf club 1.

As a result of earnest studies conducted by the inventors, it was conceived that golf club 1 having club length L not shorter than 45.5 inches can achieve an increased head speed when a value of r/L is equal to or not smaller than 0.658 and equal to or not greater than 0.732, where r represents a distance from upper end 2*a* of grip 2 to center of gravity G of golf club 1.

With a value of ratio of the center of gravity r/L being smaller than 0.658, a mass of the weight becomes great and hence club mass m of golf club 1 becomes greater. Therefore, moment of inertia I becomes greater. Thus, a head speed cannot increase. Therefore, a value of ratio of the center of gravity r/L is set to 0.658 or greater. In addition, the inventors found that a head speed tends to lower as a value of ratio of the center of gravity r/L is greater than 0.732. Therefore, the value of ratio of the center of gravity r/L is set to 0.732 or smaller.

Golf club 1 has a value of ratio of the center of gravity r/L equal to or not smaller than 0.658 and equal to or not greater than 0.732, where r represents a distance from upper end 2*a* of grip 2 to center of gravity G of golf club 1, so that a head speed can be increased in long-length golf club 1 having club length L not shorter than 45.5 inches.

In golf club 1 in one embodiment of the present invention, a value of distance r from upper end 2*a* of grip 2 to center of gravity G of golf club 1 is preferably equal to or not smaller than 0.785 m and equal to or not greater than 0.865 m. When a value of r is smaller than 0.785 m, a mass of a weight becomes great and hence club mass m of golf club 1 becomes greater. Therefore, moment of inertia I becomes greater. Thus, a head speed cannot increase. Therefore, a value of r is set to 0.785 m or greater. In addition, the inventors found that a head speed tends to lower as a value of r is greater than 0.865 m. Therefore, the value of r is set to 0.865 m or smaller.

Golf club 1 in one embodiment of the present invention has a value of distance r from upper end 2*a* of grip 2 to center of gravity G of golf club 1 equal to or not smaller than 0.785 m and equal to or not greater than 0.865 m, so that a head speed can be increased in long-length golf club 1 having club length L not shorter than 45.5 inches.

Golf club 1 in one embodiment of the present invention preferably has a value of club length L not less than 46.5 inches. It was found that even golf club 1 in one embodiment of the present invention having a value of club length L not less than 46.5 inches can achieve an increased head speed. Thus, even when club length L is increased to 46.5 inches or longer, a head speed can be increased.

Golf club 1 in one embodiment of the present invention preferably has a value of ratio of the center of gravity r/L equal to or not smaller than 0.693 and equal to or not greater than 0.720. As a result of earnest studies conducted by the inventors, it was conceived that a long-length golf club can achieve improvement in ease in swing when a value of ratio of the center of gravity r/L is equal to or not smaller than 0.693 and equal to or not greater than 0.720.

Thus, golf club 1 in one embodiment of the present invention has a value of ratio of the center of gravity r/L equal to or not smaller than 0.693 and equal to or not greater than 0.720, so that a head speed can be increased and ease in swing can also be improved. Therefore, increase in head speed and improvement in ease in swing can both be achieved.

Golf club 1 in one embodiment of the present invention preferably has a value of distance r from upper end 2*a* of grip 2 to center of gravity G of golf club 1 equal to or not smaller than 0.818 m and equal to or not greater than 0.850 m. Thus, golf club 1 in one embodiment of the present invention having a value of r equal to or not smaller than 0.818 m and equal to or not greater than 0.850 m can achieve improved ease in swing. Therefore, a head speed can be increased and ease in swing can also be improved.

Golf club 1 in one embodiment of the present invention preferably has a value of Lp equal to or not smaller than 1.082 m and equal to or not greater than 1.109 m, where Lp represents an equivalent pendulum length of golf club 1 with upper end 2*a* of grip 2 serving as axis of rotation 5.

As a result of earnest studies conducted by the inventors, it was conceived that long-length golf club 1 having a value of equivalent pendulum length Lp equal to or not smaller than 1.082 m and equal to or not greater than 1.109 m obtains favorable preference evaluation from a golfer. Thus, golf club 1 in one embodiment of the present invention having a value of equivalent pendulum length Lp equal to or not smaller than 1.082 m and equal to or not greater than 1.109 can achieve an increased head speed and obtain favorable evaluation from a golfer. In addition, improvement in ease in swing can also be achieved.

Golf club 1 in one embodiment of the present invention preferably has a weight for adjusting r arranged in an area distant from upper end 2*a* of grip 2 by not shorter than 0.1 m and not longer than 0.5 m. Thus, by making smaller distance r from upper end 2*a* of grip 2 to center of gravity G of golf club 1, ratio of the center of gravity r/L is optimized and a head speed can be increased. In addition, favorable evaluation can be obtained from a golfer by arranging a weight at the lower end of the grip. Moreover, since a range of a position of the weight can be selected, a degree of freedom in design can be improved.

Preferably, the golf club in one embodiment of the present invention has a weight having a mass equal to or not smaller than 12 g and equal to or not greater than 40 g. Thus, by making smaller distance r from upper end 2*a* of grip 2 to center of gravity G of golf club 1, ratio of the center of gravity r/L is optimized and a head speed can be increased. In addition, since a range of a mass of the weight can be selected, a degree of freedom in design can be improved.

Preferably, golf club 1 in one embodiment of the present invention has the weight formed of tungsten-containing pre-preg. Thus, by employing the tungsten-containing pre-preg used for manufacturing golf club 1 for a weight, a special manufacturing apparatus is not necessary and hence productivity can be improved.

EXAMPLES

An example of the present invention will be described hereinafter. It is noted that elements the same as or corresponding to those above have the same reference characters allotted and description thereof may not be repeated.

Example 1

Premises of Example 1 are initially shown. Here, attention being paid to a radius of rotation, a length of rotation and the like, a head speed of a conventional long-length golf club was studied. Thus, it was verified that a head speed does not necessarily increase even though a golf club has a longer length, although it has commonly been said that a head speed increases as the golf club has a longer length. The inventors verified that a head speed could be increased by lowering the ratio of the center of gravity of the golf club, which will be described below in detail.

Initially, wood-type golf clubs with the specifications shown in Table 1 were fabricated with a conventional design method as Comparative Examples X, Y and Z. It is noted that denotations for the golf club shown in FIGS. 1 and 2 correspond to the same denotations in Comparative Examples in Tables 1 to 3.

TABLE 1

| | L (in) | L (m) | m (kg) | r (m) | Ig (kg · m$^2$) | I (kg · m$^2$) | mr (kg · m) | Lp (m) | r/L |
|---|---|---|---|---|---|---|---|---|---|
| Comparative Example X | 45 | 1.143 | 0.307 | 0.850 | 0.0585 | 0.280 | 0.261 | 1.073 | 0.744 |
| Comparative Example Y | 46 | 1.168 | 0.297 | 0.876 | 0.0597 | 0.287 | 0.260 | 1.104 | 0.750 |
| Comparative Example Z | 47.5 | 1.207 | 0.290 | 0.900 | 0.0629 | 0.298 | 0.261 | 1.142 | 0.746 |

Each denotation in Table 1 will be described. L represents a club length, and L (in) represents a length in inch and L (m) represents a length in meter. In addition, m (kg) represents a club mass. Further, r represents a distance from the upper end of the grip to the center of gravity of the golf club. Ig (kg·m$^2$) represents moment of inertia around a position of the center of gravity. I (kg·m$^2$) represents moment of inertia around the upper end of the grip. In addition, mr (kg·m) represents first moment. Lp (m) represents an equivalent pendulum length. Further, r/L represents a ratio of the center of gravity.

Regarding each measurement item shown in Tables 2 and 3, 6 subjects A to F were subjected to swing measurement for each of Comparative Examples X, Y and Z. All of 6 subjects were golfers high in analytical skills, among which a golfer with single-figure handicap was also included. More specifically, a motion capture system "MAC 3D System" manufactured by Motion Analysis Corporation was used to conduct measurement for each golf club in Comparative Examples X, Y and Z. Each measurement value in Tables 2 and 3 is a value obtained 10 ms (millisecond) before impact.

TABLE 2

| | | Subject | | | | | | |
|---|---|---|---|---|---|---|---|---|
| | | A | B | C | D | E | F | Average |
| Comparative Example X | Impact ω Angular Velocity (rad/s) | 32.5 | 26.4 | 27.8 | 31.5 | 33.0 | 32.2 | 30.6 |
| | $V_{CG} = \omega \times r_1$ Velocity of Center of Gravity (m/s) | 29.3 | 26.2 | 26.1 | 28.4 | 29.9 | 28.4 | 28.0 |

TABLE 2-continued

| | | Subject | | | | | | |
|---|---|---|---|---|---|---|---|---|
| | | A | B | C | D | E | F | Average |
| | $Vh = V_{CG} \times L_1/r_1$ Head Speed (m/s) | 39.0 | 34.1 | 34.4 | 37.8 | 39.7 | 38.0 | 37.2 |
| Comparative Example Y | Impact ω Angular Velocity (rad/s) | 32.7 | 27.4 | 28.4 | 30.5 | 33.7 | 31.9 | 30.8 |
| | $V_{CG} = \omega \times r_1$ Velocity of Center of Gravity (m/s) | 30.3 | 27.8 | 27.4 | 29.0 | 31.1 | 29.0 | 29.1 |
| | $Vh = V_{CG} \times L_1/r_1$ Head Speed (m/s) | 40.0 | 36.0 | 35.9 | 38.0 | 41.1 | 38.5 | 38.3 |
| Comparative Example Z | Impact ω Angular Velocity (rad/s) | 31.8 | 26.3 | 27.8 | 29.0 | 32.5 | 30.8 | 29.7 |
| | $V_{CG} = \omega \times r_1$ Velocity of Center of Gravity (m/s) | 30.1 | 28.1 | 27.9 | 28.5 | 31.1 | 28.9 | 29.1 |
| | $Vh = V_{CG} \times L_1/r_1$ Head Speed (m/s) | 40.0 | 36.3 | 36.6 | 37.6 | 41.3 | 38.5 | 38.4 |

TABLE 3

| | | Subject | | | | | | |
|---|---|---|---|---|---|---|---|---|
| | | A | B | C | D | E | F | Average |
| Comparative Example X | Radius of Rotation $r_1$ (m) | 0.901 | 0.992 | 0.939 | 0.903 | 0.905 | 0.882 | 0.920 |
| | Length of Rotation $L_1$ (m) | 1.199 | 1.290 | 1.237 | 1.201 | 1.203 | 1.180 | 1.218 |
| | $L_1/r_1$ | 1.331 | 1.300 | 1.317 | 1.330 | 1.329 | 1.338 | 1.324 |
| Comparative Example Y | Radius of Rotation $r_1$ (m) | 0.927 | 1.016 | 0.965 | 0.950 | 0.923 | 0.910 | 0.948 |
| | Length of Rotation $L_1$ (m) | 1.224 | 1.314 | 1.263 | 1.248 | 1.220 | 1.207 | 1.246 |
| | $L_1/r_1$ | 1.321 | 1.293 | 1.308 | 1.313 | 1.322 | 1.327 | 1.314 |
| Comparative Example Z | Radius of Rotation $r_1$ (m) | 0.947 | 1.067 | 1.004 | 0.984 | 0.958 | 0.938 | 0.983 |
| | Length of Rotation $L_1$ (m) | 1.259 | 1.380 | 1.316 | 1.297 | 1.271 | 1.250 | 1.295 |
| | $L_1/r_1$ | 1.330 | 1.293 | 1.311 | 1.317 | 1.326 | 1.333 | 1.319 |

Figure 2:
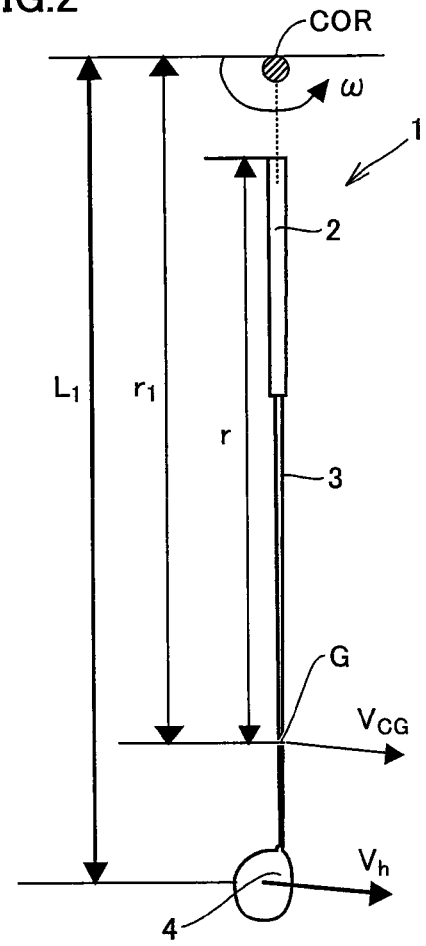
FIG. 2 is a schematic diagram illustrating rotational motion of the golf club.

Each denotation in Tables 2 and 3 will be described. Referring to FIG. 2, angular velocity impact ω (rad/s) represents an angular velocity of a golf club around center of rotation COR. Radius of rotation $r_1$ (m) represents a distance between a position of the center of gravity and center of gyration COR of a golf club. Length of rotation $L_1$ (m) represents a distance between the head and center of rotation COR of a golf club. Velocity of the center of gravity Vcg (m/s) represents a velocity of a position of the center of gravity of a golf club and it is expressed as $Vcg=\omega \times r_1$. Head speed Vh (m/s) represents a head speed of a golf club and it is expressed as $Vh=L_1/r_1 \times Vcg$.

Referring to Table 2, when Comparative Example X and Comparative Example Y are compared with each other, it was found that head speed Vh increased by 1.1 m/s from 37.2 m/s to 38.3 m/s, with reference to the average. It was thus found that Comparative Example Y in which club length L was set to 46 inches was higher in head speed than Comparative Example X in which club length L was set to 45 inches.

On the other hand, when Comparative Example Y and Comparative Example Z are compared with each other, it was found that head speeds Vh were 38.3 m/s and 38.4 m/s with reference to the average, respectively, and there was almost no difference. It was thus found that an effect of increase in head speed could not be seen even though club length L was increased from 46 inches in Comparative Example Y to 47.5 inches in Comparative Example Z.

Referring to FIG. 2, as described above, motion of golf club 1 can be rotational motion determined by center of rotation COR and radius of rotation $r_1$ that momently vary. When a swing is decomposed for consideration, the longer golf club 1 is, the greater length of rotation $L_1$ and radius of rotation $r_1$ become. Therefore, simply increasing a club length of a golf club does not lead to greater $L_1/r_1$.

In addition, as shown in Table 2, it was found that a velocity of a position of the center of gravity (velocity of the center of gravity) Vcg hardly varied between Comparative Example Y and Comparative Example Z. Therefore, if $L_1/r_1$ can be made greater, a head speed can be increased. It was found that, in order to achieve greater $L_1/r_1$, golf club 1 having a long length and having a position of the center of gravity at hand was effective.

Referring to FIG. 1, since a value calculated by dividing distance r from the upper end of the grip to the center of gravity of the golf club by club length L represents ratio of the center of gravity r/L, increase in $L_1/r_1$ corresponds to lowering in ratio of the center of gravity r/L. Thus, the present inventors verified that a head speed could be increased by lowering ratio of the center of gravity r/L of golf club 1.

Example 1 of the present invention will now be described. In Example 1, attention being paid to a ratio of the center of gravity and the like, a head speed, a ball initial velocity, a carry, and the like of a long-length golf club were studied based on verification above. Thus, it was verified that a head speed and the like could be improved by optimizing a ratio of the center of gravity and the like. Examples B, E, F, and G are examples according to the present invention. Comparative Examples A, H and I are comparative examples for the present invention.

Wood-type golf clubs with the specifications shown in Table 4 were fabricated as Examples and Comparative Examples denoted with A, B, E, F, G, H, and I. It is noted that denotations for the golf club shown in FIG. 1 correspond to the same denotations in Examples and Comparative Examples in Table 4. In each of Examples B, E, F, and G, a weight was arranged around the upper end of the grip. In Comparative Examples A, H and I, no weight was provided.

TABLE 4

| | L (in) | L (m) | m (kg) | r (m) | Ig (kg · m$^2$) | I (kg · m$^2$) | mr (kg · m) | r/L |
|---|---|---|---|---|---|---|---|---|
| Comparative Example A | 45 | 1.143 | 0.301 | 0.893 | 0.0535 | 0.294 | 0.269 | 0.781 |
| Example B | 47 | 1.194 | 0.328 | 0.785 | 0.0869 | 0.289 | 0.258 | 0.658 |
| Example E | 48 | 1.219 | 0.322 | 0.810 | 0.0872 | 0.298 | 0.261 | 0.664 |
| Example F | 45.5 | 1.156 | 0.321 | 0.840 | 0.0847 | 0.311 | 0.269 | 0.727 |
| Example G | 46.5 | 1.181 | 0.315 | 0.865 | 0.0698 | 0.305 | 0.272 | 0.732 |
| Comparative Example H | 45 | 1.143 | 0.320 | 0.920 | 0.0887 | 0.360 | 0.294 | 0.805 |
| Comparative Example I | 46 | 1.168 | 0.330 | 0.932 | 0.0897 | 0.376 | 0.308 | 0.798 |

Regarding each measurement item shown in Table 5, Examples and Comparative Examples A, B, E, F, G, H, and I were subjected to measurement. More specifically, a ball was hit with each golf club in each of Examples and Comparative Examples A, B, E, F, G, H, and I and measurement was conducted for each measurement item, with the use of a hit ball analysis apparatus "Pythagoras" manufactured by Mizuno.

TABLE 5

| | Head SP (m/s) | Ball SP (m/s) | Hitting Vertical (°) | Hitting Lateral (°) | B Spin (rpm) | Ratio of Meet | Carry (yard) |
|---|---|---|---|---|---|---|---|
| Comparative Example A | 44.3 | 61.7 | 12.6 | −0.3 | 3400 | 1.40 | 233.8 |
| Example B | 45.7 | 63.0 | 13.1 | −1.0 | 3331 | 1.38 | 238.8 |
| Example E | 46.1 | 63.5 | 14.1 | −0.4 | 3235 | 1.38 | 240.0 |
| Example F | 45.9 | 63.3 | 14.0 | −0.5 | 3125 | 1.38 | 239.1 |
| Example G | 45.8 | 63.2 | 14.1 | −0.2 | 3069 | 1.38 | 239.2 |
| Comparative Example H | 44.0 | 61.2 | 13.9 | 0.1 | 3114 | 1.39 | 229.8 |
| Comparative Example I | 43.7 | 60.7 | 14.2 | −0.3 | 3315 | 1.39 | 228.1 |

Each measurement item in Table 5 will be described. Head SP (m/s) represents a head speed of a golf club. Ball SP (m/s) represents a ball initial velocity at the time of hitting with a golf club. Hitting vertical) (° represents a vertical angle of a ball at the time when it was hit with a golf club. Hitting lateral) (° represents a lateral angle of a ball at the time when it was hit with a golf club. It is noted that a right direction with respect to a fly ball line is indicated with a positive figure, while a left direction is indicated with a negative figure. B spin (rpm) represents the number of revolutions of backspin of a ball. Ratio of meet refers to a value calculated by dividing ball SP by head SP. Carry (yard) represents a carry of a ball.

Figure 3:
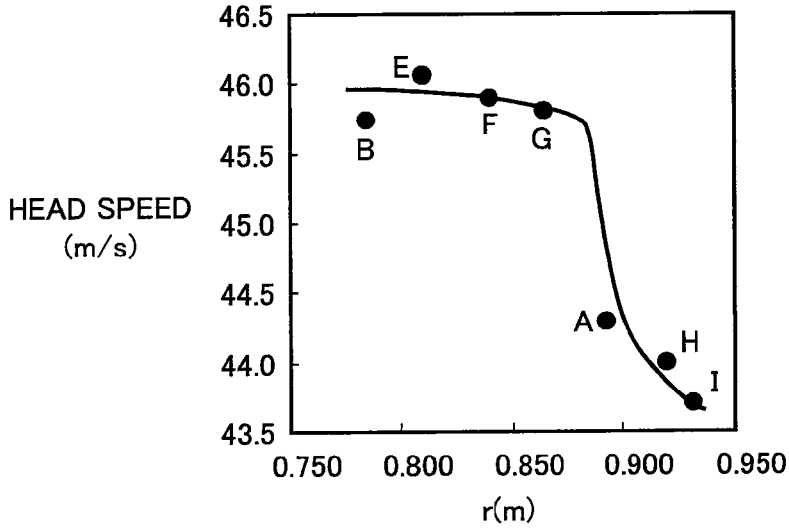
FIG. 3 is a diagram showing relation between a head speed and a distance from an upper end of a grip to the center of gravity of the golf club in Example 1.
Figure 4:
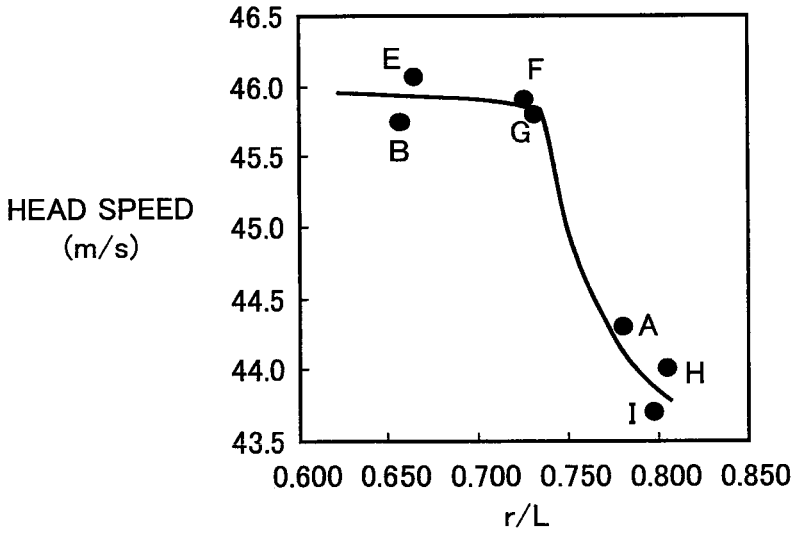
FIG. 4 is a diagram showing relation between a head speed and a ratio of the center of gravity in Example 1.

FIG. 3 shows relation between r shown in Table 4 and a head speed shown in Table 5. FIG. 4 shows relation between r/L shown in Table 4 and a head speed shown in Table 5. Referring to Tables 4 and 5 and FIGS. 3 and 4, head speeds (m/s) in Examples B, E, F, and G are much higher than those in Comparative Examples A and H in which L (in) was set to 45 inches.

Thus, it was found that a head speed (m/s) could be much higher than in a case where L (in) was set to 45 inches, by setting a value of r/L to be equal to or not smaller than 0.658 and equal to or not greater than 0.732. In addition, it was found that a head speed (m/s) could be increased even in a case where L (in) was greater than 45.5 inches, by setting a value of r/L to be equal to or not smaller than 0.658 and equal to or not greater than 0.732.

Moreover, it was found that a head speed (m/s) could be much higher than in a case where L (in) was set to 45 inches, by setting a value of r (m) to be equal to or not smaller than 0.785 m and equal to or not greater than 0.865 m. It was found that a head speed (m/s) could be increased even in a case where L (in) was greater than 45.5 inches, by setting a value of r (m) to be equal to or not smaller than 0.785 m and equal to or not greater than 0.865 m.

Figure 5:
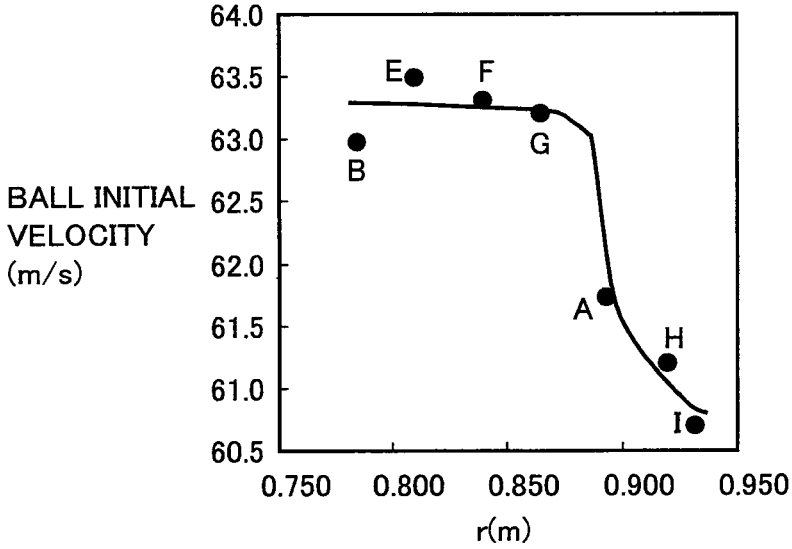
FIG. 5 is a diagram showing relation between a ball initial velocity and a distance from the upper end of the grip to the center of gravity of the golf club in Example 1.
Figure 6:
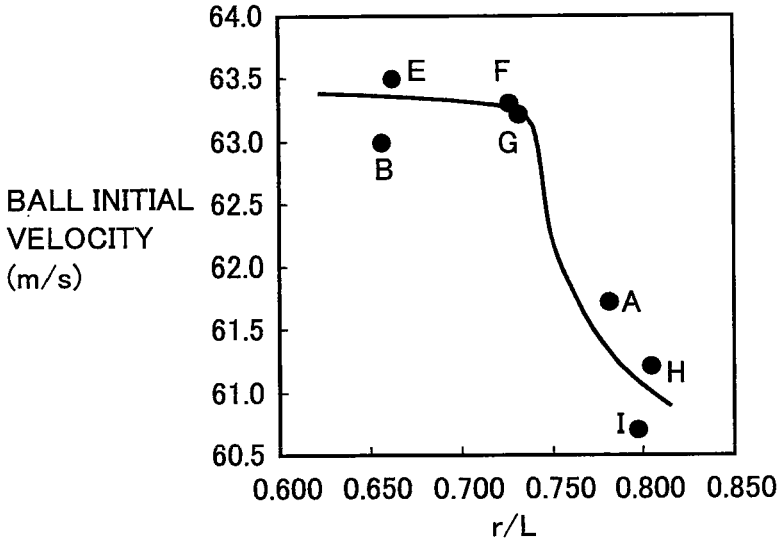
FIG. 6 is a diagram showing relation between a ball initial velocity and a ratio of the center of gravity in Example 1.

FIG. 5 shows relation between r shown in Table 4 and a ball initial velocity shown in Table 5. FIG. 6 shows relation between r/L shown in Table 4 and a ball initial velocity shown in Table 5. Referring to Tables 4 and 5 and FIGS. 5 and 6, ball initial velocities (m/s) in Examples B, E, F, and G are much higher than those in Comparative Examples A and H in which L (in) was set to 45 inches.

Thus, it was found that a ball initial velocity (m/s) could be much higher than in a case where L (in) was set to 45 inches, by setting a value of r/L to be equal to or not smaller than 0.658 and equal to or not greater than 0.732. In addition, it was found that a ball initial velocity (m/s) could be increased even in a case where L (in) was greater than 45.5 inches, by setting a value of r/L to be equal to or not smaller than 0.658 and equal to or not greater than 0.732.

Moreover, it was found that a ball initial velocity (m/s) could be much higher than in a case where L (in) was set to 45 inches, by setting a value of r (m) to be equal to or not smaller than 0.785 m and equal to or not greater than 0.865 m. It was found that a ball initial velocity (m/s) could be increased even in a case where L (in) was greater than 45.5 inches, by setting a value of r (m) to be equal to or not smaller than 0.785 m and equal to or not greater than 0.865 m.

Figure 7:
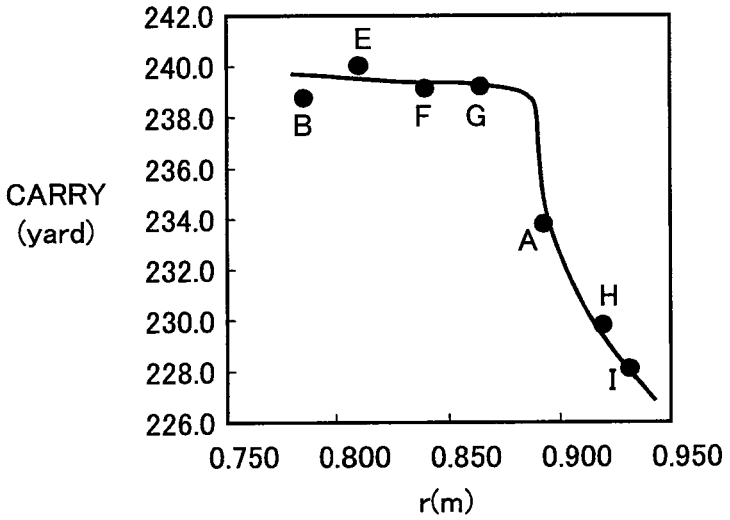
FIG. 7 is a diagram showing relation between a carry and a distance from the upper end of the grip to the center of gravity of the golf club in Example 1.

FIG. 7 shows relation between r shown in Table 4 and a carry shown in Table 5.

Figure 8:
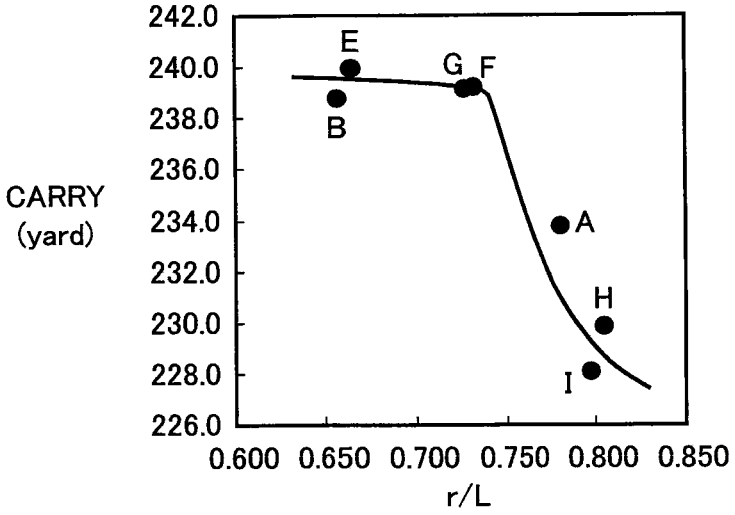
FIG. 8 is a diagram showing relation between a carry and a ratio of the center of gravity in Example 1.

FIG. 8 shows relation between r/L shown in Table 4 and a carry shown in Table 5. Referring to Tables 4 and 5 and FIGS. 7 and 8, carries (yard) in Examples B, E, F, and G are much higher than those in Comparative Examples A and H in which L (in) was set to 45 inches.

Thus, it was found that a carry (yard) could be much higher than in a case where L (in) was set to 45 inches, by setting a value of r/L to be equal to or not smaller than 0.658 and equal to or not greater than 0.732. In addition, it was found that a carry (yard) could be increased even in a case where L (in) was set to 47 inches greater than 45.5 inches, by setting a value of r/L to be equal to or not smaller than 0.658 and equal to or not greater than 0.732.

Moreover, it was found that a carry (yard) could be much higher than in a case where L (in) was set to 45 inches, by setting a value of r (m) to be equal to or not smaller than 0.785 m and equal to or not greater than 0.865 m. It was found that a carry (yard) could be increased even in a case where L (in) was greater than 45.5 inches, by setting a value of r (m) to be equal to or not smaller than 0.785 m and equal to or not greater than 0.865 m.

From the foregoing, it was found that Examples B, E, F, and G were superior to Comparative Examples A, H and I in all of a head speed, a ball initial velocity, and a carry. In Examples B, E, F, and G, L (in) was set to 45.5 to 48 inches. Therefore, it is expected that similar tendency is found in a case where L (in) is equal to or greater than 45.5 inches or at least up to 48 inches for which measurement was conducted.

In addition, in Examples B, E and G, L (in) was set to 46.5 inches or longer. Therefore, it was found that a head speed could be increased even when L (in) was equal to or greater than 46.5 inches. Further, it was also found that a ball initial velocity could be increased and a carry could be greater.

Example 2

Example 2 of the present invention will now be described. In Example 2, a head speed of a long-length golf club in the present example was studied, with attention being paid to a radius of rotation, a length of rotation, and the like.

Regarding each measurement item shown in Table 6, 5 subjects A, B, C, E, and F were subjected to swing measurement for each golf club in Comparative Example A, Example B, and Example E described in Example 1 above. All of 5 subjects were golfers high in analytical skills, among which a golfer with single-figure handicap was also included. More specifically, a motion capture system "MAC 3D System" manufactured by Motion Analysis Corporation was used to conduct measurement for each golf club in Comparative Example A, Example B, and Example E as above.

TABLE 6

| | | Subject | | | | | |
|---|---|---|---|---|---|---|---|
| | | A | B | C | E | F | Average |
| Comparative Example A | Radius of Rotation $r_1$ (m) | 0.940 | 1.018 | 0.951 | 0.936 | 0.907 | 0.951 |
| | Length of Rotation $L_1$ (m) | 1.195 | 1.273 | 1.206 | 1.191 | 1.162 | 1.206 |
| | $L_1/r_1$ | 1.271 | 1.250 | 1.268 | 1.272 | 1.281 | 1.269 |
| | $Vh = V_{CG} \times L_1/r_1$ Head Speed (m/s) | 38.4 | 33.5 | 33.5 | 39.4 | 36.7 | 36.3 |
| Example B | Radius of Rotation $r_1$ (m) | 0.849 | 0.915 | 0.879 | 0.845 | 0.816 | 0.861 |
| | Length of Rotation $L_1$ (m) | 1.251 | 1.317 | 1.281 | 1.247 | 1.218 | 1.263 |
| | $L_1/r_1$ | 1.474 | 1.440 | 1.458 | 1.476 | 1.492 | 1.468 |
| | $Vh = V_{CG} \times L_1/r_1$ Head Speed (m/s) | 39.6 | 34.7 | 34.1 | 41.8 | 38.0 | 37.6 |
| Example E | Radius of Rotation $r_1$ (m) | 0.873 | 0.922 | 0.887 | 0.857 | 0.831 | 0.874 |
| | Length of Rotation $L_1$ (m) | 1.279 | 1.328 | 1.293 | 1.263 | 1.237 | 1.280 |
| | $L_1/r_1$ | 1.465 | 1.440 | 1.458 | 1.474 | 1.489 | 1.465 |
| | $Vh = V_{CG} \times L_1/r_1$ Head Speed (m/s) | 41.1 | 37.9 | 35.7 | 41.7 | 39.7 | 39.2 |

Referring to Table 6, it was found that a head speed in Example B increased by 1.3 m/s with reference to the average, as compared with Comparative Example A. In addition, it was found that a head speed in Example E increased by 2.9 m/s with reference to the average, as compared with Comparative Example A.

The reason is considered as follows. In Example B, the club length was 47 inches, and in Example E, the club length was 48 inches. Owing to an effect of decrease in r shown in Table 4 as compared with that in Comparative Example A, Examples B and E were smaller in radius of rotation $r_1$ than Comparative Example A. As a result of influence thereby as well, a head speed in Examples B and E increased as compared with Comparative Example A. Thus, it was verified that a head speed could be increased even in a case where the golf club in the present example has a club length of 47 inches and 48 inches.

Example 3

Example 3 of the present invention will now be described. Examples K, L, M, and N are examples according to the present invention. Comparative Example J is a comparative example for the present invention.

Wood-type golf clubs with the specifications shown in Table 7 were fabricated as Examples and Comparative Example denoted with J to N. It is noted that denotations for the golf club shown in FIG. 1 correspond to the same denotations in Table 7. In Comparative Example J, no weight was arranged. In Examples K and L, a weight was arranged at the upper end of the grip. In Example K, the weight had a mass of 40 g. In Example L, the weight had a mass of 20 g. In Examples M and N, a weight was arranged at the lower end of the grip. More specifically, since a grip length was 270 mm, the weight was arranged at a position distant from the upper end of the grip by 270 mm to 300 mm, in a range of 30 mm. In Example M, the weight had a mass of 40 g. In Example N, the weight had a mass of 20 g.

TABLE 7

| | L (in) | L (m) | m (kg) | r (m) | Ig ($kg \cdot m^2$) | I ($kg \cdot m^2$) | mr ($kg \cdot m$) | Lp (I/mr) (m) | r/L |
|---|---|---|---|---|---|---|---|---|---|
| Comparative Example J | 46.5 | 1.181 | 0.296 | 0.884 | 0.0602 | 0.291 | 0.261 | 1.115 | 0.748 |
| Example K | 46.5 | 1.181 | 0.335 | 0.786 | 0.0868 | 0.294 | 0.263 | 1.116 | 0.665 |
| Example L | 46.5 | 1.181 | 0.317 | 0.829 | 0.0763 | 0.294 | 0.263 | 1.119 | 0.702 |

TABLE 7-continued

| | L (in) | L (m) | m (kg) | r (m) | Ig (kg · m$^2$) | I (kg · m$^2$) | mr (kg · m) | Lp (I/mr) (m) | r/L |
|---|---|---|---|---|---|---|---|---|---|
| Example M | 46.5 | 1.181 | 0.335 | 0.818 | 0.0722 | 0.296 | 0.274 | 1.082 | 0.693 |
| Example N | 46.5 | 1.181 | 0.316 | 0.850 | 0.0667 | 0.295 | 0.268 | 1.098 | 0.720 |

Each sensory evaluation item shown in Table 8 was evaluated in each of Examples and Comparative Example J to N. More specifically, evaluation was made based on an average value obtained in such a manner that each of 12 subjects hit five balls with a wood-type golf club in each of Examples and Comparative Example J to N. Among these 12 subjects, a professional golfer high in analytical skills was included as a subject.

TABLE 8

| | Ease in Swing | Timing | Preference |
|---|---|---|---|
| Comparative Example J | 4.20 | 3.80 | 3.47 |
| Example K | 4.27 | 4.00 | 3.93 |
| Example L | 4.67 | 4.20 | 4.00 |
| Example M | 5.00 | 4.93 | 4.87 |
| Example N | 4.73 | 4.47 | 4.20 |

Three items of ease in swing, timing and preference were set as the sensory evaluation items. A paired comparison test, which is the most representative sensory test, was employed as the sensory evaluation method. Regarding each sensory evaluation item, seven-grade evaluation was made, in which score 7 represents "very good", score 6 represents "good", score 5 represents "somewhat good", score 4 represents "neither good or bad," score 3 represents "somewhat bad", score 2 represents "bad", and score 1 represents "very bad".

Regarding ease in swing, a golf club easier in swing gained higher evaluation. Regarding timing, a golf club easier in timing gained higher evaluation. Regarding preference, a preferred golf club gained higher evaluation.

Figure 9:
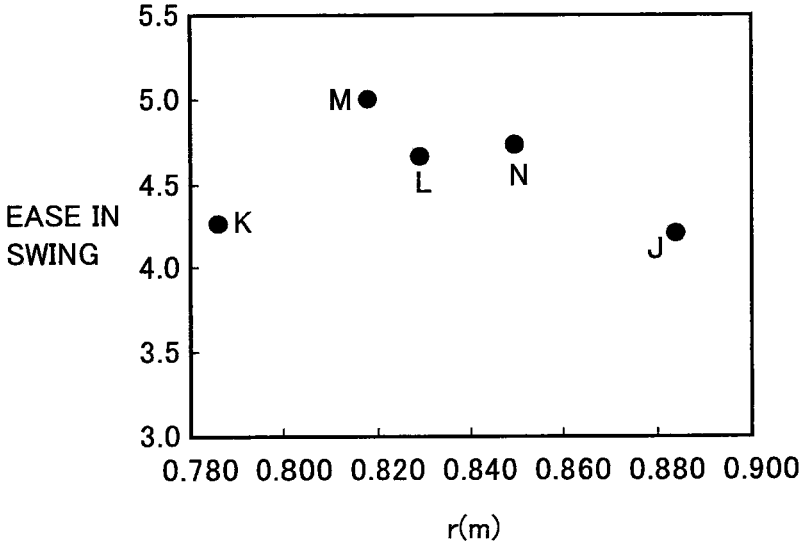
FIG. 9 is a diagram showing relation between ease in swing and a distance from the upper end of the grip to the center of gravity of the golf club in Example 3.
Figure 10:
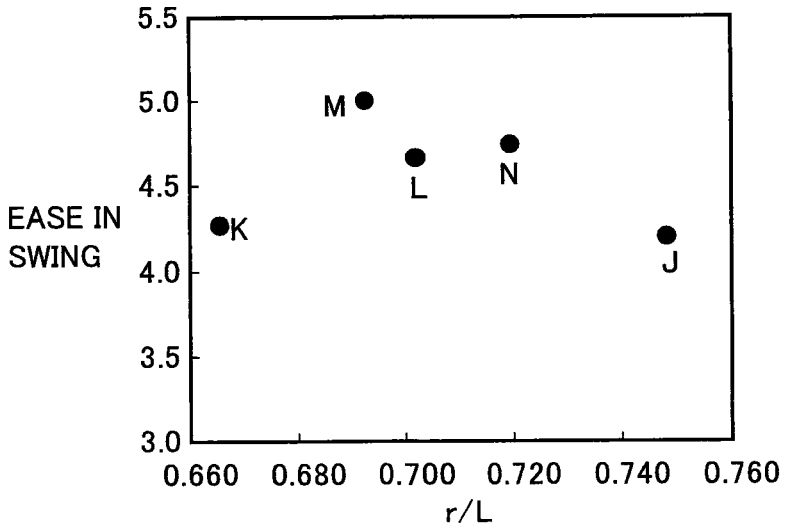
FIG. 10 is a diagram showing relation between ease in swing and a ratio of the center of gravity in Example 3.

FIG. 9 shows relation between r shown in Table 7 and ease in swing shown in Table 8. FIG. 10 shows relation between r/L shown in Table 7 and ease in swing shown in Table 8. Referring to Tables 7 and 8 and FIGS. 9 and 10, evaluation of ease in swing is significantly higher in Examples L, M and N than in Comparative Example J and Example K.

Thus, it was found that ease in swing could significantly be improved by setting a value of r/L to be equal to or not smaller than 0.693 and equal to or not greater than 0.720. In addition, it was found that ease in swing could significantly be improved by setting a value of r to be equal to or not smaller than 0.818 m and equal to or not greater than 0.850 m.

Figure 11:
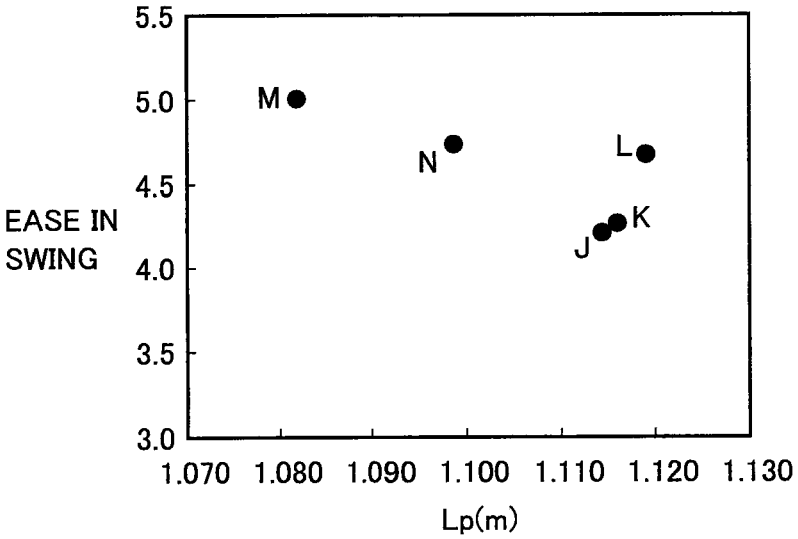
FIG. 11 is a diagram showing relation between ease in swing and an equivalent pendulum length in Example 3.

FIG. 11 shows relation between Lp shown in Table 7 and ease in swing shown in Table 8. Referring to Table 7 and FIG. 11, evaluation of ease in swing is significantly higher in Examples M and N than in Comparative Example J and Example K, as well as than Example L. Thus, it was found that ease in swing could further be improved by setting a value of Lp to be equal to or not smaller than 1.082 m and equal to or not greater than 1.098 m.

Figure 12:
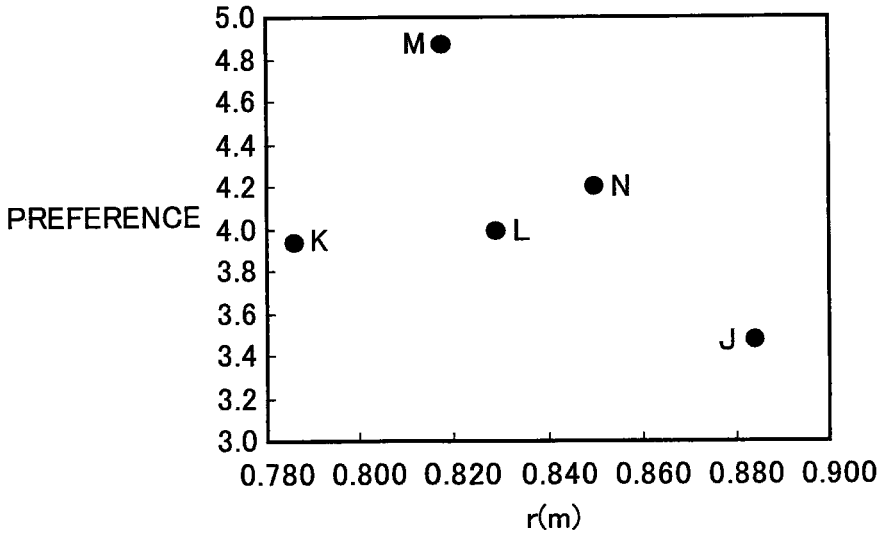
FIG. 12 is a diagram showing relation between preference and a distance from the upper end of the grip to the center of gravity of the golf club in Example 3.
Figure 13:
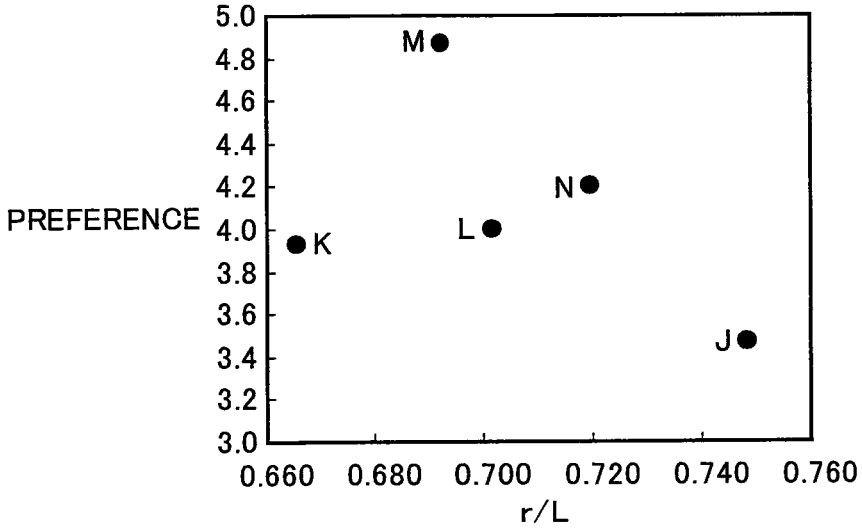
FIG. 13 is a diagram showing relation between preference and a ratio of the center of gravity in Example 3.
Figure 14:
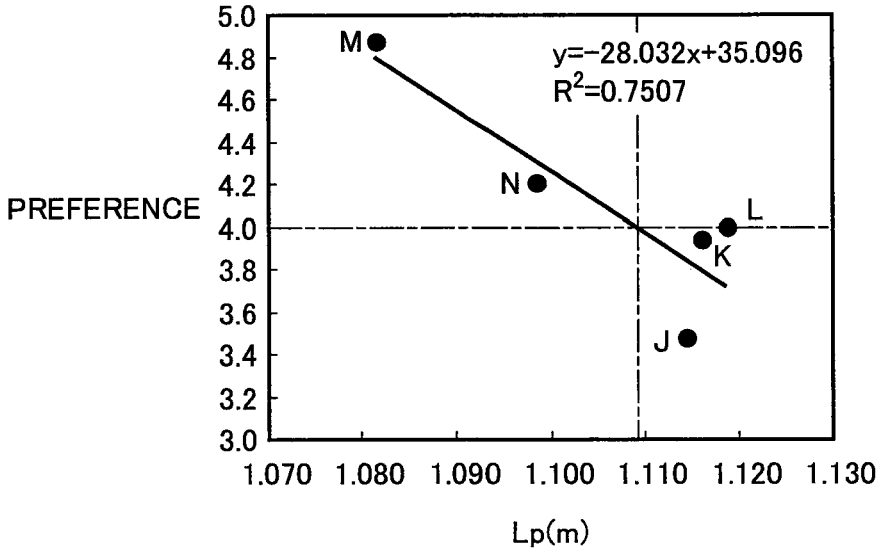
FIG. 14 is a diagram showing relation between preference and an equivalent pendulum length in Example 3.

FIG. 12 shows relation between r shown in Table 7 and preference shown in Table 8. FIG. 13 shows relation between r/L shown in Table 7 and preference shown in Table 8. FIG. 14 shows relation between Lp shown in Table 7 and preference shown in Table 8. Referring to Tables 7 and 8 and FIG. 14, preference evaluation is significantly higher in Example M than in Comparative Example J and Examples K and L. In addition, Example M is higher in evaluation also than Example N.

Thus, it was found that preference evaluation could significantly be high by setting a value of Lp to 1.082 m or greater. In addition, regarding Lp and preference evaluation, a regression line is calculated and expressed as the following equation (2). It is noted that y represents preference evaluation and x corresponds to Lp.

$$y=-28.032x+35.096 \quad (2)$$

In this case, coefficient of determination $R^2=0.7507$ and coefficient of correlation R=0.8664, both of which are highly reliable values. Regarding preference evaluation, based on the equation (2), y=4 representing favorable evaluation was assumed for calculation. Then, x=1.109 is obtained. Thus, it was found that favorable evaluation could be obtained by setting a value of Lp to 1.109 or smaller.

In addition, Examples M and N are significantly higher in preference evaluation than Examples K and L. Thus, it was found that preference evaluation was significantly higher when the weight was arranged at the lower end of the grip than when the weight was arranged at the upper end of the grip.

In addition, the weight was arranged in an area distant from the upper end of the grip by not shorter than 0.1 m and not longer than 0.5 m. Moreover, a mass of the weight of 12 g, 20 g, 22 g, 32 g, or 40 g was adopted. Further, tungsten-containing pre-preg was adopted for the weight. It was found that results the same as above were obtained in these cases. When tungsten-containing pre-preg was adopted for the weight, a golf club was manufactured by layering tungsten-containing pre-preg on the shaft. Thus, it was found that a golf club could be manufactured with the same manufacturing method as that for a conventional golf club when tungsten-containing pre-preg was adopted for the weight.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A golf club having a value of L not less than 45.5 inches, L representing a club length measured with a 60-degree method, comprising:

a shaft;

a grip attached to one end of said shaft; and a head attached to the other end of said shaft, and a value of r/L being equal to or not smaller than 0.658 and equal to or not greater than 0.732, where r represents a distance from an upper end of said grip to center of gravity of said golf club;

wherein said value of L is not less than 46.5 inches;

wherein said value of r/L is equal to or not smaller than 0.693 and equal to or not greater than 0.720;

wherein a value of said r is equal to or not smaller than 0.818 m and equal to or not greater than 0.850 m;

wherein a value of Lp is equal to or not smaller than 1.082 m and equal to or not greater than 1.109 m, where Lp represents an equivalent pendulum length of said golf club with the upper end of said grip serving as an axis of rotation; and wherein a weight for adjusting said r is arranged in an area distant from the upper end of said grip by not shorter than 0.1 m and not longer than 0.5 m.

2. The golf club according to claim 1, wherein said weight has a mass equal to or not smaller than 12 g and equal to or not greater than 40 g.

3. The golf club according to claim 1, wherein said weight is formed of tungsten-containing pre-preg.

* * * * *